United States Patent [19]

Miyata et al.

[11] 4,025,938

[45] May 24, 1977

[54] LIQUID DEVELOPER RESERVOIR FOR COPYING MACHINE

[75] Inventors: Shizuo Miyata, Osaka; Motokazu Nakao, Sakurai, both of Japan

[73] Assignee: Sharp Kabushiki Kaisha, Osaka, Japan

[22] Filed: May 16, 1975

[21] Appl. No.: 578,175

[30] Foreign Application Priority Data

May 17, 1974 Japan ..... 49-55914
May 17, 1974 Japan ..... 49-55915

[52] U.S. Cl. ..... 354/324
[51] Int. Cl.[2] ..... G03D 3/02; G03G 15/10
[58] Field of Search ..... 355/10, 27, 28; 354/297, 319, 320, 322, 324, 326, 331, 336, 338; 118/DIG. 23; 427/15

[56] References Cited

UNITED STATES PATENTS

| | | | |
|---|---|---|---|
| 1,462,019 | 7/1923 | Morant | 354/319 |
| 3,062,123 | 11/1962 | Limberger | 354/324 X |
| 3,282,177 | 11/1966 | Stanton | 355/10 |
| 3,538,835 | 11/1970 | Needleman | 354/324 |
| 3,577,259 | 5/1971 | Sato et al. | 355/10 X |
| 3,650,196 | 3/1972 | Hosoe et al. | 354/324 |
| 3,722,453 | 3/1973 | Dahlquist et al. | 118/DIG. 23 X |
| 3,851,662 | 12/1974 | Jessop | 354/324 X |

*Primary Examiner*—Fred L. Braun
*Attorney, Agent, or Firm*—Birch, Stewart, Kolasch & Birch

[57] ABSTRACT

A liquid developer reservoir for use in a copying machine comprises at least two sections one of which is adapted to receive a photosensitive paper carrying an electrostatic latent image formed thereon and to be subjected to the developing operation. Developing liquid is supplied to one of the sections and led out from the other section, both sections being connected to each other to permit the developing liquid to flow from the former to the latter. A vertical partition separates one section of the reservoir from the other and has an aperture at the bottom thereof for providing the desired liquid flow between the sections.

5 Claims, 7 Drawing Figures

LIQUID DEVELOPER RESERVOIR FOR COPYING MACHINE

BACKGROUND OF THE INVENTION

The present invention relates to a liquid developer reservoir for a copying machine.

When a liquid developing method is adopted to develop an electrostatic latent image formed on a photosensitive paper after passing steps of a charging and an exposure, a developing period or a time period when the photosensitive paper is dipped in a developing liquid is an important factor to obtain a clean copy. Especially, when the photosensitive paper is driven downward and upward to be dipped in the developing liquid, difference of the developing period between the leading edge and the trailing edge of the photosensitive paper causes a difference of development contrast. To avoid the occurrence of the development contrast difference, it was necessary, in the prior art, to dip the photosensitive paper in the developing liquid of considerably low concentration during a considerably long period necessary for bringing the developing section into saturated concentration. Therefore, it took more than 10 seconds to obtain clean copy in the prior art method. When the liquid developing method of the above-mentioned prior art was adopted to a multicolor electrophotography apparatus, a considerably long period was required to complete a sheet of multicolor image formation, since the developing operation was repeated at least three times.

It is effective to use a toner having a relatively high speed attachment velocity characteristic in order to reduce a necessary time period to perform the developing operation. In this case, the toner located near the surface of the photosensitive paper may be rapidly attached to the photosensitive paper, but the toner concentration will become dilute near the surface of the photosensitive paper. The toner must be supplied to the diluted portion by mechanically stirring or circulating the developing liquid.

OBJECTS AND SUMMARY OF THE INVENTION

Accordingly, an object of the present invention is to provide a liquid developer reservoir suitable for obtaining a clean copy in a copying machine.

Another object of the present invention is to provide a liquid developer reservoir of novel construction suitable for continuously supplying developing liquid to the surface of a photosensitive paper.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, a liquid developer reservoir is divided into at least two sections one of which is adapted to receive a photosensitive paper carrying an electrostatic latent image formed thereon and driven downward. Developing liquid is supplied to one of the sections with the use of a pump or by virtue of the siphon behavior. The two sections are connected to each other to perform the flow of the developing liquid. The other of the sections is so constructed that superfluous developing liquid will overflow and be led to a developer tank.

A developing electrode is preferably provided along a wall of the liquid developer reservoir facing against the photosensitive surface of the photosensitive paper in order to intensify electric lines of force caused by the electrostatic latent image formed on the photosensitive paper.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
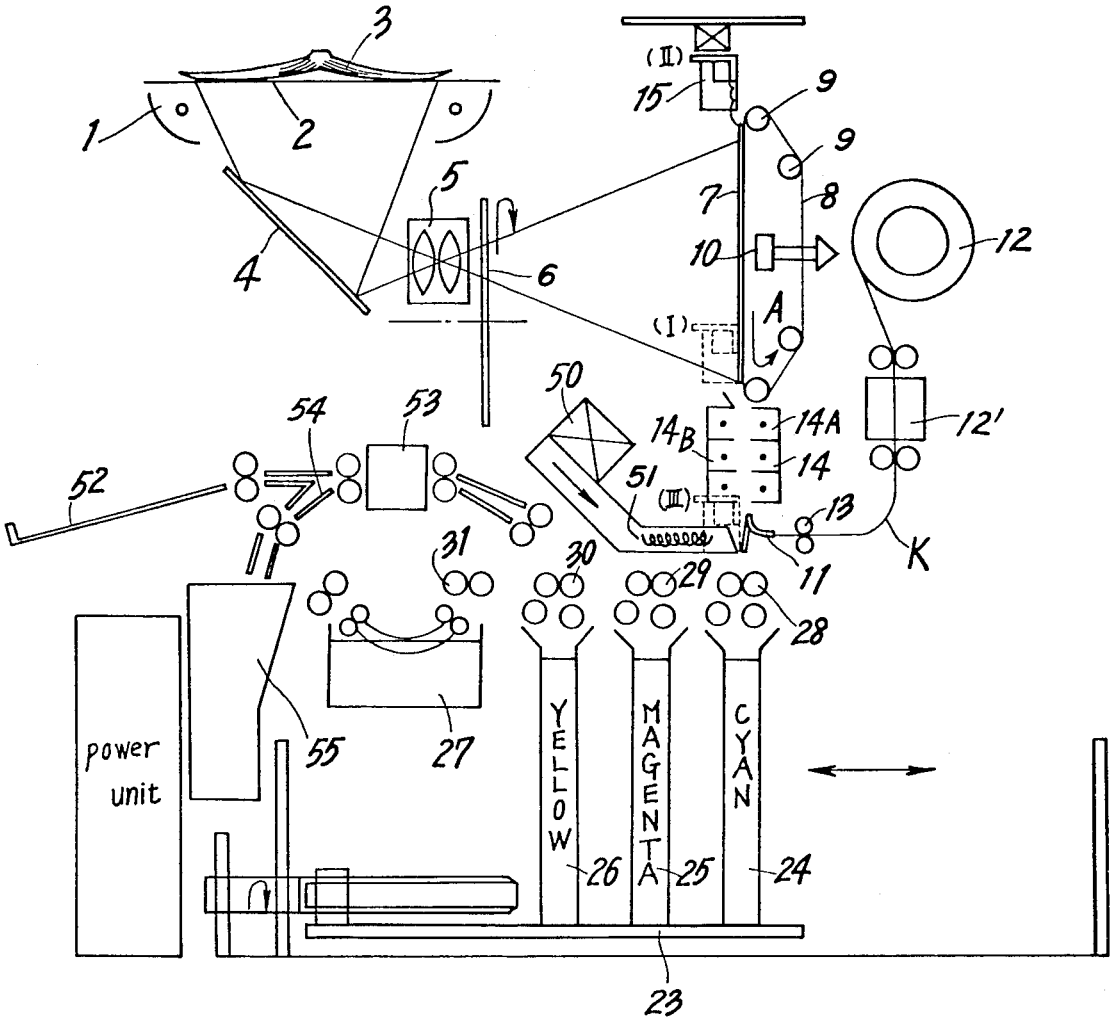
FIG. 1 is a sectional view of a copying machine suitable for employing a liquid developer reservoir of the present invention.

Referring now in detail to the drawings, and to facilitate a more complete understanding of the present invention, a multicolor copying machine suitable for employing a liquid developer reservoir of the present invention will be first described with reference to FIG. 1.

A light source 1 is secured below a glass plate 2 on which there is mounted an original 3 to be duplicated. Light rays reflected downward from the original 3 impinge on a reflector mirror 4, which directs an optical image of the original 3 toward an exposure position through a lens unit 5 and a color filter disc 6. The filter disc 6 which carries a plurality of different colored filters, for example, red colored filter, green colored filter, blue colored filter and colorless filter, is provided for rotation about a fixed point so that the optical image projected on the exposure position changes in color with the rotation of the filter disc 6.

A paper holding table 7 of a hollow construction positioned parallel to and adjacent to the exposure surface, has preferably a length somewhat longer than the maximum size of a photosensitive paper used with the present copying machine and a number of apertures which will be described below in more detail. A plurality of conveying belts 8 travel above the top surface of the paper table 7 in the parallel relationship to each other with the use of a predetermined number of rollers 9, the direction of the conveying belts 8 being marked by the arrow A, namely, counterclockwise direction. One of the rollers is coupled with a driving system.

The apertures mentioned above are positioned on the surface of the paper table 7 on which no conveying belts 8 are provided, so that they communicate with a fan 10. An extension force of the conveying belt 8 and an attraction force of the fan 10 in combination are effective to prevent the copy sheet from deviating away from the exposure position and thereby causing the copy sheet to fit perfectly to the even surface of the paper table 7.

The photosensitive copy sheet K supplied from a roll 12 travels through a cutting unit 12', rollers 13, a paper guide 11, a corona charging unit 14 toward the lowest edge position of the paper table 7. A paper carriage 15 arrests the photosensitive copy sheet K at the lowest edge position of the paper table 7 and transports and carries upward the same along the even surface of the paper table 7. The paper guide 11 is rotatably provided to move away from the course of the travelling copy paper K. Furthermore, the corona charging unit 14 comprises a stationary section 14A and a movable section 14B, the latter being rotatable thereby deviating from the course of the travelling copy paper K while the copy sheet K is travelling upward and downward.

A development station comprises a developer bed 23 which is adapted to move only in the horizontal direction, that is, perpendicular to the travelling course of the copy paper K. The developer bed 23 bears a plurality of liquid developer reservoirs 24, 25, 26 and 27 thereon each containing different colored developer toners, for example, cyan developer toner, magenta toner, yellow toner and black toner, these colors corresponding to complementary colors of the filters 6 as already discussed above. The developer bed 23 may travel either intermittently or successively upon every completion of the single color image formation process. That is to say, the copy paper K passing past the charge formation station and the optical exposure station falls to the lowest edge position of the paper table 7 and then enters into one of the developer reservoirs 24 through 27, said one developer reservoir being positioned beneath the lowest edge position of the table 7. The intermittent or successive movement of the developer bed 23 causes change in color of the developer reservoir positioned beneath the table 7. Rollers 28 through 31 conduct the copy paper K to the liquid developer reservoirs 24 through 27. The driving force for the paper carriage 15 may be afforded by any appropriate means well known in the art for example a motor. In addition, it will be noted that the conveying belt 8 travels in the direction opposite to that of the paper carriage 15 only when the latter travels upward. In short, the copy paper K enters into first the cyan colored developer reservoir 24 and returns to the charge formation station and the exposure station and then falls into the next succeeding magenta developer reservoir 25. This follows that the magenta color developed image is superimposed on the cyan color developed image. Thereafter, the yellow colored development and the black colored development are successively accomplished on the same copy paper K. A fixing station which comprises a dryer fan 50 and a heater filament 51 is deposited between the development station and the charge formation station. After multicolor copying operation the copy paper K is fed to a paper tray 52 via a cutter 53 and a selector 54, whereby the waste paper is cut away from the copy paper K being conducted to a paper drain 55.

As noted earlier, the copy sheet K has in its travelling course three fixed positions as identified by (I), (II) and (III).

The present invention relates to the liquid developer reservoirs 24 through 26 of FIG. 1.

Figure 2:
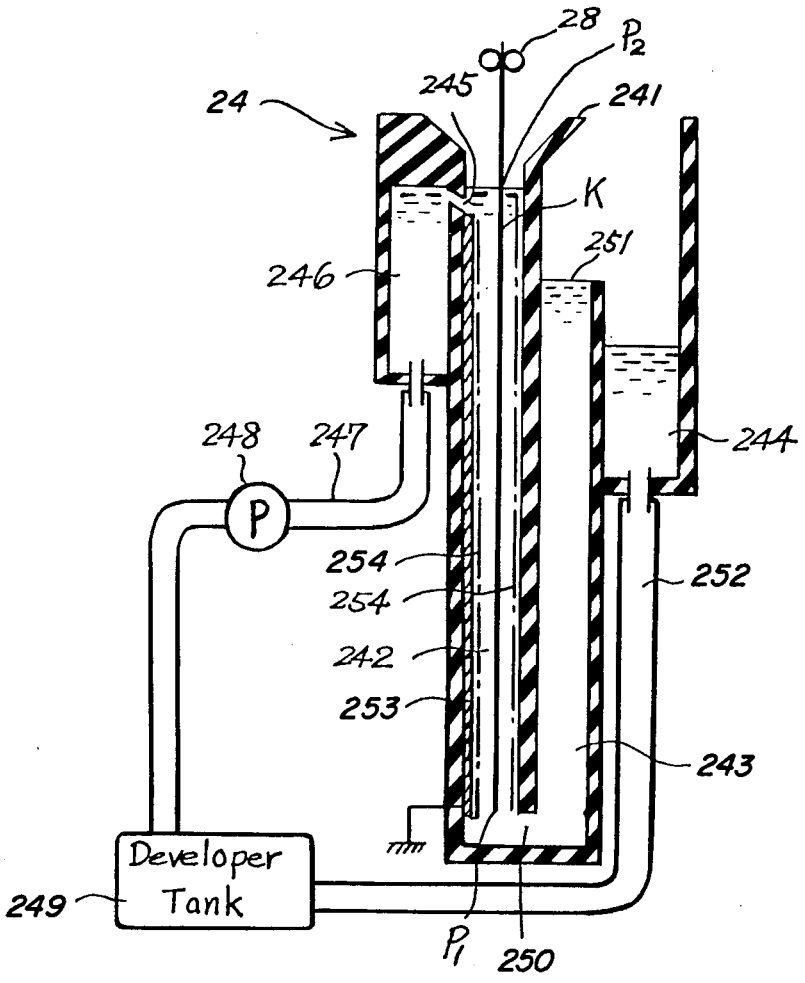
FIG. 2 is a sectional view of a first embodiment of the liquid developer reservoir of the present invention.

Referring now to FIG. 2, there is illustrated a typical construction of the liquid developer reservoirs, wherein only the liquid developer reservoir 24 containing cyan developer toner is illustrated and other liquid developer reservoirs 25 and 26 are omitted from the drawing for the purpose of simplicity, since the liquid developer reservoirs 25 and 26 can be constructed in the same manner as that of the liquid developer reservoir 24.

The liquid developer reservoir 24 mainly comprises a pouring section 242, an outflow section 243, and a superfluous liquid reserving section 244. A pouring aperture 245 is provided on the upper part of the side wall of the pouring section 242. The pouring aperture 245 is connected with a liquid developer tank 249 via a connection unit 246, a conduit 247 and a circulation pump 248. A partition wall 241 made of insulating material such as acryl resin and ABS resin is provided between the pouring section 242 and the outflow section 243. A communicating aperture 250 is positioned below the low end of the partition wall 241 to permit a liquid flow therethrough. An upper end 251 of the outflow section 243 is positioned lower than the pouring aperture 245. The superfluous developing liquid from the upper end 251 of the outflow section 243 is led to the liquid developer tank 249 via the superfluous liquid reserving section 244 and a conduit 252. The roller 28 conducts the copy paper K to the pouring section 242 as already discussed above with reference to FIG. 1, the copy paper K carrying the electrostatic latent image formed thereon. A flat plate developing electrode 253 made of conductive material such as aluminum is provided along a side wall of the pouring section 242 to face against the photosensitive surface carrying the electrostatic latent image thereon of the photosensitive paper K, thereby amplifying electric lines of force caused by the electrostatic latent image and ensuring clean development.

Figure 3:
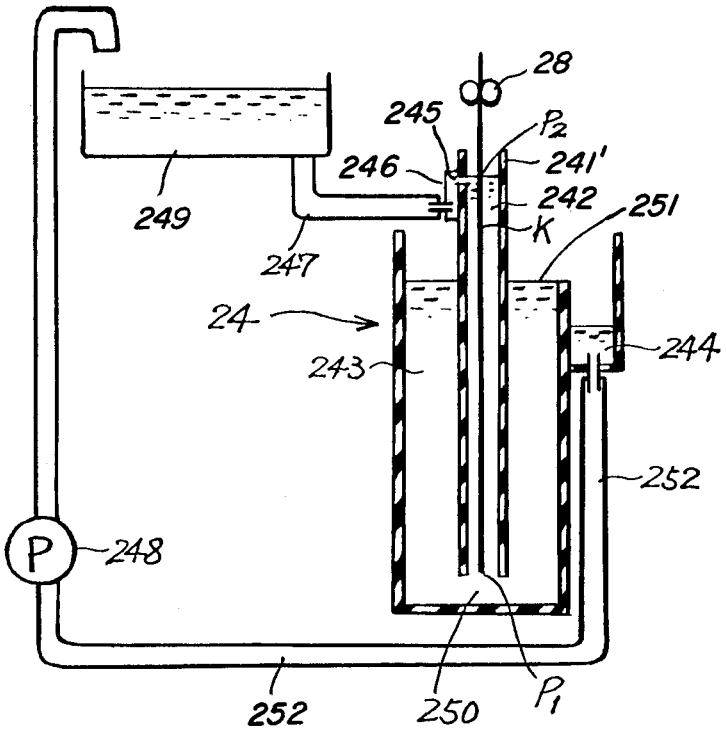
FIG. 3 is a sectional view of a second embodiment of the liquid developer reservoir of the present invention.

Referring now to FIG. 3, there is illustrated another embodiment of the liquid developer reservoir of the present invention, wherein like elements corresponding to those of FIG. 2 are indicated by like numerals.

A pouring section 242 is provided within an outflow section 243 with the use of a cylindrical partition wall 241'. In this embodiment the developing liquid supply is achieved by virtue of the siphon behavior. A circulation pump 248 is provided for conducting the superfluous liquid in a superfluous liquid reserving section 244 to a liquid developer tank 249 via a conduit 252.

Figure 4:
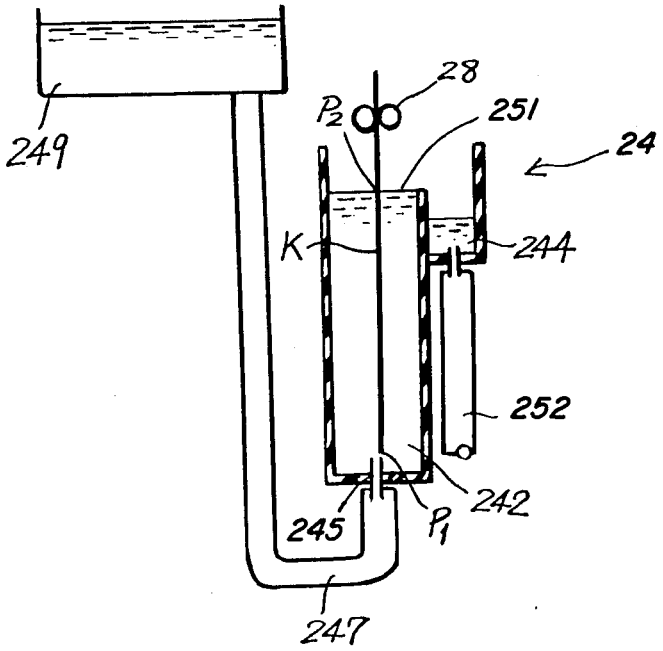
FIG. 4 is a sectional view of a third embodiment of the liquid developer reservoir of the present invention.

Referring now to FIG. 4, there is illustrated still another embodiment of the liquid developer reservoir of the present invention, wherein like elements corresponding to those of FIGS. 2 and 3 are indicated by like numerals.

In this embodiment the partition wall is omitted and, therefore, the outflow section 243 is not provided. The developing liquid is supplied from a pouring aperture 245 provided at the bottom wall of a pouring section 242 and overflows an upper end 251 of the pouring section 242. The superfluous liquid is conducted to a liquid developer tank 249 via a conduit 252 and a circulation pump (not shown) in a same manner as that of the embodiment of FIG. 3.

Figure 5:
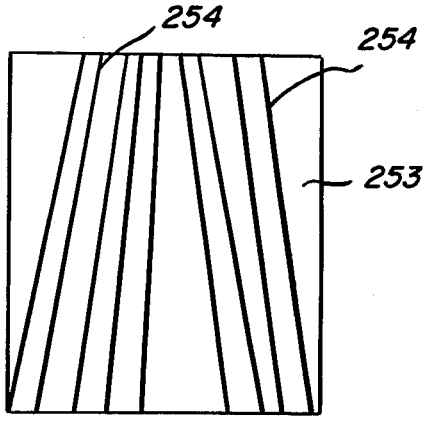
FIG. 5 is a side elevation of the liquid developer reservoir of the present invention taken along the line V — V of FIG. 2.

FIG. 5 is a side elevation of the liquid developer reservoir of the present invention taken along the line V — V of FIG. 2. Guide lines 254 made of elastic and incorrodible material such as nylon wires are provided on the surface of the developing electrode 253 and the partition wall 241 of FIG. 2 facing against the photosensitive paper K as shown in FIG. 5. The guide lines 254 facilitate the liquid developer flow in the pouring section 242 and the insertion of the photosensitive paper K into the pouring section 242. The developing liquid continuously flows downward along the guide lines 254.

When the photosensitive paper K is inserted into the pouring section 242 at a velocity $V_1$, and stationarily maintained in the pouring section 242 during a time period $t$, and then drawn out from the pouring section 242 at a velocity $V_2$, the developing period $\tau$ during which the copy paper K is dipped in the developing liquid can be expressed as follows:

at the leading edge $P_1$ of the copy paper K;

$$\tau = t + \frac{L}{V_1} + \frac{L}{V_2}$$

at the trailing edge $P_2$ of the copy paper K;

$$\tau = t$$

where L designates the distance between the leading edge $P_1$ and the trailing edge $P_2$ of the photosensitive paper K.

Figure 6:
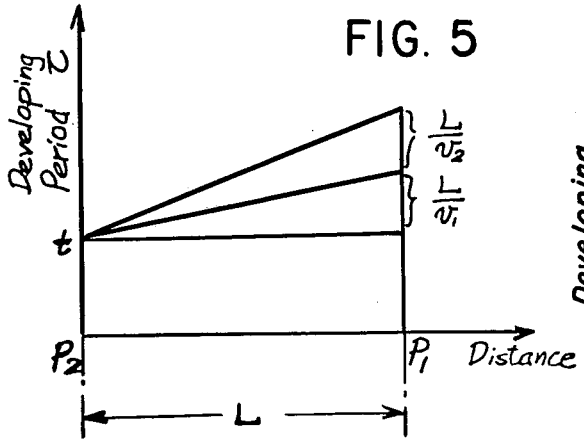
FIG. 6 is a graph showing a developing period versus distance from the trailing edge characteristics of the photosensitive paper dipped in the liquid developer reservoir of the present invention.

The above-mentioned developing period $\tau$ is shown in FIG. 6.

Figure 7:
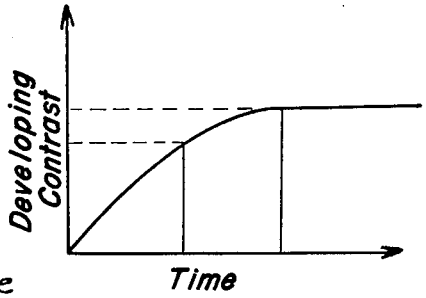
FIG. 7 is a graph showing developing contrast versus developing period characteristics of the developed image dipped in the liquid developer reservoir of the present invention.

When the developing density D is saturated at a developing period T as shown in FIG. 7, a uniformly clean copy can be obtained at the condition $\tau \geqq T$.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A liquid developer unit for use in a copying machine which forms a developed image on a photosensitive paper by virtue of sequential operations of charging, exposure and developing with movement of the photosensitive paper upward and downward, said liquid developer unit comprising:

a. a liquid developer tank;

b. a liquid developer reservoir including a pouring section;
an outflow section;
a superfluous liquid reserving section;
a vertical partition wall provided between the pouring section and the outflow section; and an aperture formed at the bottom of the partition wall for communicating the pouring section and the outflow section with each other;

c. means for conducting the photosensitive paper into the pouring section;

d. developing liquid supplying means for supplying developing liquid from the liquid developer tank to the pouring section to maintain the liquid level in the pouring section higher than that in the outflow section; and e. circulation means for conducting superfluous developing liquid from the superfluous liquid reserving section to the liquid developer tank.

2. The liquid developer unit of claim 1 wherein the developing liquid supplying means includes a pressure pump.

3. The liquid developer unit of claim 1 further comprising a developing electrode provided on the side wall of the pouring section facing against the photosensitive surface of the photosensitive paper.

4. The liquid developer unit of claim 3 wherein guide lines are provided on the surface of the developing electrode for facilitating the insertion of the photosensitive paper.

5. The liquid developer unit of claim 4 wherein the guide lines are made of nylon wires.

* * * * *